United States Patent [19]

Kobayashi et al.

[11] Patent Number: 5,021,757

[45] Date of Patent: Jun. 4, 1991

[54] BAND PASS FILTER

[75] Inventors: Fumihiko Kobayashi; Isamu Umino, both of Otawara, Japan

[73] Assignee: Fujitsu Limited, Kawasaki, Japan

[21] Appl. No.: 441,780

[22] Filed: Nov. 27, 1989

[30] Foreign Application Priority Data

Nov. 28, 1988 [JP] Japan ..... 63-301247

[51] Int. Cl.[5] ..... H01P 1/203; H01P 7/08

[52] U.S. Cl. ..... 333/205; 333/204; 333/219

[58] Field of Search ..... 333/202, 204, 205, 219, 333/238, 246

[56] References Cited

U.S. PATENT DOCUMENTS 4,578,656 3/1986 Lacour et al. ..... 333/204

4,641,116 2/1987 Shibata et al. ..... 333/219 X

FOREIGN PATENT DOCUMENTS 2613538 10/1988 France ..... 333/202

63-258101 10/1988 Japan .

0001309 5/1989 Japan ..... 333/219

1224863 4/1986 U.S.S.R. ..... 333/204

1309125 5/1987 U.S.S.R. ..... 333/204

*Primary Examiner*—Eugene R. LaRoche

*Assistant Examiner*—Seung Ham

*Attorney, Agent, or Firm*—Staas & Halsey

[57] ABSTRACT

A band pass filter is comprised of one or more filter units each having a V-shaped microwave strip line provided with two variable capacity elements at its two open ends and a high frequency elimination element connected to the apex thereof through which a control voltage for the variable capacity elements is applied.

8 Claims, 6 Drawing Sheets

10

BAND PASS FILTER

BACKGROUND OF THE INVENTION

1. Field of the Invention

The present invention relates to a band pass filter which is preferably applied to, for example, a radio apparatus used in an earth station for satellite communication. Further, the band pass filter can be a type with a variable center frequency.

In a radio apparatus used in an earth station for satellite communication, it is a recent trend to enable the center frequency of the band pass filter (hereinafter referred to simply as BPF), which is located at a stage after a frequency conversion stage in the apparatus, variable, in order to make the local oscillator in the apparatus operate as a synthesizer. This is because, the frequency allocation for each earth station is often changed for a variety of reasons. Therefore, it is desired for each earth station to have a variable frequency local oscillator. For this, the BPF should accordingly also be a variable center frequency type.

In the prior art, as will be explained hereinafter in detail, the variable center frequency BPF produces the following two disadvantages. The first is that the BPF becomes relatively large in size. The second is that insertion loss by the insertion of a center frequency varying means into the BPF is increased. This causes a undesired reduction of attenuation level in a frequency range outside the frequency range to be passed through the BPF and also undesired distortion of the filtering characteristics.

SUMMARY OF THE INVENTION

Accordingly, an object of the present invention is to provide a miniaturized band pass filter which is adapted to have a variable frequency without increasing the insertion loss or producing any distortion of the filtering characteristics.

To attain the above object, the band pass filter (BPF) is comprised of one filter unit having a V-shaped configuration. The V-shaped filter can be provided with a center frequency varying means which is comprised of two variable capacity elements connected to two respective open ends and a high frequency band elimination element connected to the apex thereof through which a control voltage is applied to the two variable capacity elements.

BRIEF DESCRIPTION OF THE DRAWINGS

The above object and features of the present invention will be more apparent from the following description of the preferred embodiments with reference to the accompanying drawings, wherein.

DESCRIPTION OF THE PREFERRED EMBODIMENTS

Before describing the embodiments of the present invention, the related art and the disadvantages therein will be described with reference to the related figures.

Figure 1:
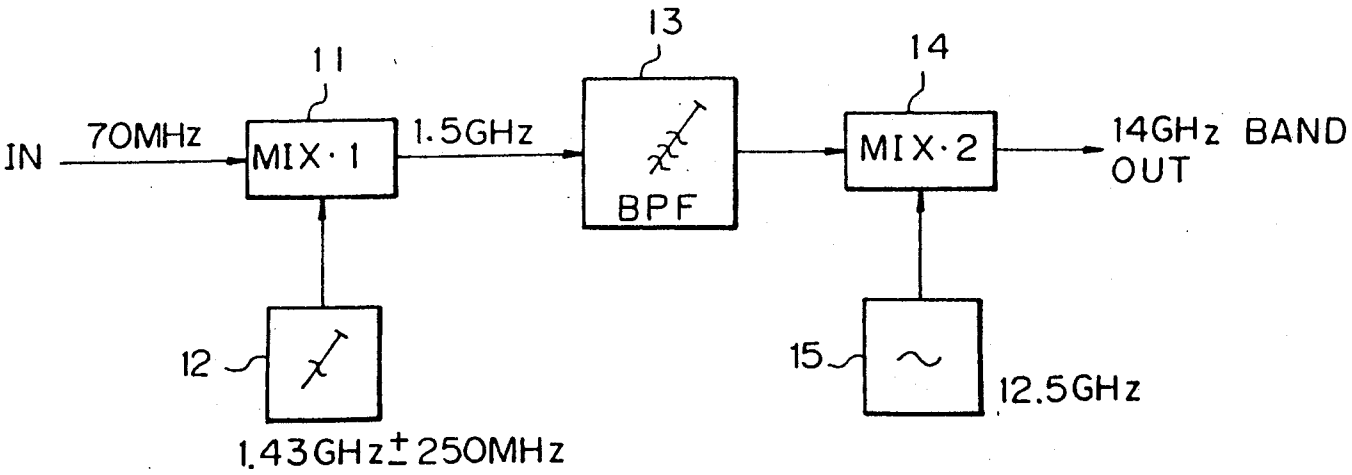
FIG. 1 is a block diagram showing an example of a circuit to which the present invention is preferably adopted.

FIG. 1 is a block diagram showing an example of a circuit to which the present invention is preferably adopted. In FIG. 1, a circuit 10 serves as a radio transmitting apparatus for satellite communication, and more particularly to both a first frequency converter and a second frequency converter in the radio transmitting apparatus. The circuit 10 is comprised, as illustrated, of a first mixer (MIX.1) 11, a first local oscillator 12, a variable center frequency band pass filter (BPF) 13, a second mixer 14 and a second local oscillator 15. The following explanation will be given by assuming a case, as an example, where the first local oscillator 12 can produce a local oscillation signal having any frequency selected from a frequency range of, e.g., 1.43 GHz+250 MHz and the second local oscillator 15 produces a local oscillation signal having a frequency of, e.g., 12.5 GHz.

A modulation signal (IN) having a frequency of, e.g., 70 MHz, is mixed, at the first mixer 11, with the local oscillation signal of 1.43 GHz from the first local oscillator 12 to be converted into a modulation signal having a frequency of 1.5 GHz. Further, the modulation signal of 1.5 GHz is applied, via the BPF 13, to the second local oscillator 14 to be mixed with the local oscillation signal of 12.5 GHz and the thus frequency converted signal is transmitted externally, via another BPF (not shown), from the circuit 10 as a modulation signal (OUT) having a transmission frequency in the 14 GHz band.

During the above operation, any undesired wave other than the transmission frequency should be eliminated in order to prevent the undesired wave from having a deleterious influence on the related circuit. For this, the BPF 13 is employed at the output side of the first mixer 11 to suppress the undesired local oscillation signal, an image signal, and so on inevitably output from the first mixer 11.

The BPF 13 should be small in size and also should not exhibit a deterioration of filtering characteristics even if the center frequency thereof varies in conformity with a variation in frequency of the local oscillation signal in the aforesaid frequency range of 1.43 GHz+250 MHz given by the first local oscillator 12.

Figure 2A:
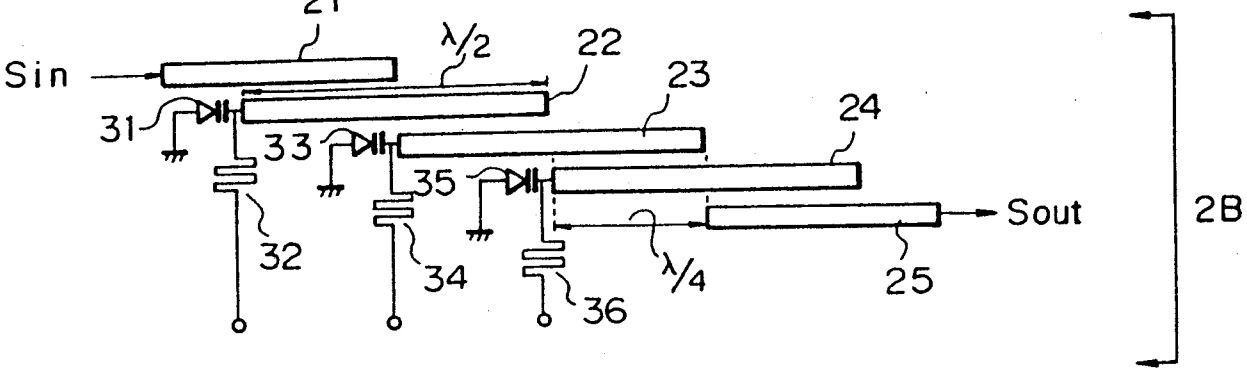
Fig. 2A (PRIOR ART)
FIG. 2A is a plan view of a prior art band pass filter.
Figure 2B:
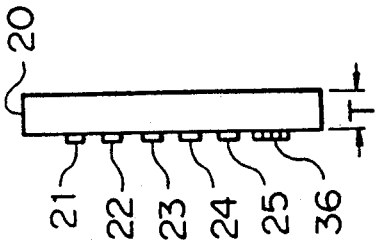
Fig. 2B (PRIOR ART)
FIG. 2B is a side view seen from the arrow 2B in FIG. 2A.

FIG. 2A is a plan view of a prior art band pass filter. And FIG. 2B is a side view seen from the arrow 2B in FIG. 2A.

In FIG. 2A, reference numerals 21, 22, 23, 24 and 25 represent microwave strip lines. Particularly, 21 represents an input side microwave strip line for receiving an input signal $S_{in}$ and 25 represents an output side microwave strip line for providing an output signal $S_{out}$. The intermediate strip lines are open at one end with the other ends thereof connected to respective variable capacity diodes 31, 33 and 35, and to choke elements 32, 34 and 36 for each variable capacity diode. Each of the microwave strip lines 22 through 24 is a $\lambda/2$ wavelength line. Half of one microwave strip line is coupled with half of the adjacent microwave strip line at a common $\lambda/4$ wavelength portion.

The lateral length of each of the intermediate microwave strip lines 22, 23 and 24 is, for example, on the order of 4 to 5 cm and the input and output side microwave strip lines 21 and 25 have a length of about 3 cm when the operating frequency is 1.5 GHz, and the strip lines 21 to 25 are formed on a dielectric substrate 20 (refer to FIG. 2B) made of a glass containing epoxy resin having a thickness (T in FIG. 2B) of 1.6 mm. Note that the character λ denotes a wavelength on the dielectric substrate obtained at a frequency which is in a vicinity of an upper limit frequency but is not lower than the upper limit frequency of a variable center frequency range.

Referring again to FIG. 2A, the functional structure of the microwave strip lines 21 through 25 excluding the variable capacity diodes 31, 33, 35 and the choke elements 32, 34, and 36 is identical to a BPF disclosed in (C) on page 102 of "Microwave Circuit for Communication" by Kazuhiro Miyauchi and Heiichi Yamamoto, published by the Institute of Electronics and Communication on Oct. 20, 1981. The BPF shown in FIGS. 2A and 2B corresponds to a BPF which is a combination of the disclosed BPF with both the variable capacity diodes for varying the center frequency and the choke elements for supplying control voltages connected to respective diodes.

Assuming here that the above mentioned control voltage is varied in a range between, e.g., 0 V and 10 V, the thus varied control voltages are applied, via the choke elements 32, 34, and 36, to the variable capacity diodes 31, 33, and 35, respectively, so that each variable capacity diode changes its capacity in a range between, e.g., 1 pF and 7 pF. Thus, the larger the capacity becomes, the lower the center frequency shifts.

Regarding the size of the aforementioned BPF, in a case where the BPF is operated at a frequency lower than the quasi-microwave band, e.g., 2 GHz such as, for example, 1.5 GHz, the microwave strip lines of the BPF become necessarily long, and accordingly, the size of overall BPF becomes large. This makes it difficult to accommodate the BPF in the related radio apparatus which has become miniaturized in recent years.

Regarding the filtering capability of the aforementioned BPF, the filtering characteristics are deteriorated largely when the center frequency thereof is varied. This is derived from the fact that, as previously mentioned, an insertion loss caused by an insertion of a center frequency varying means into the BPF is increased. This causes an undesired reduction in attenuation level in a frequency range outside the frequency range to be passed through the BPF and also an undesired distortion of the filtering characteristics. This will further be analyzed below. The choke elements 32, 34, and 36 are connected at respective connecting points between the microwave strip lines 22, 23, 24 and the corresponding variable capacity diodes 31, 33, and 35, respectively; or connected at respective open ends of the microwave strip lines 22, 23, and 24 even though the related structure is not illustrated in the figure. With the above arrangement of the choke elements, the choke elements have an influence on the impedance of the related resonator each comprised of both a variable capacity diode (31, 33, 35) and a corresponding microwave strip line (22, 23, 24). The influence on the impedance apparently induces the disadvantage of the above mentioned filtering characteristics. Here it is important to note that each choke element is not connected at a short-circuit node created along the microwave strip line, and therefore, has an influence on the impedance of said resonator.

Figure 3:
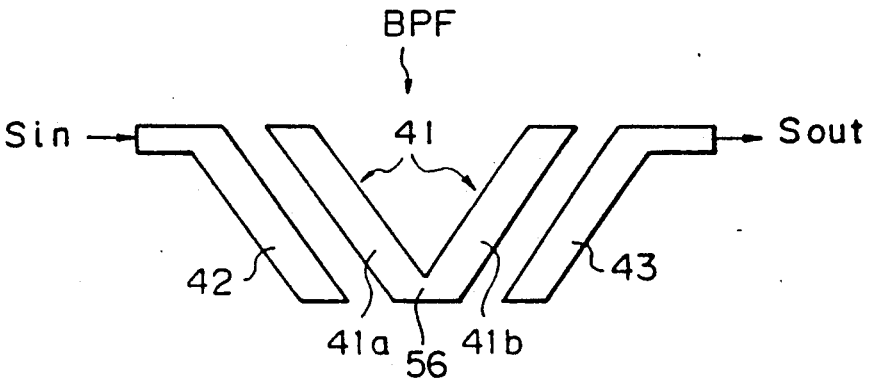
FIG. 3 depicts a principle structure of a band pass filter according to the present invention.

FIG. 3 depicts a principle structure of a band pass filter according to the present invention. In FIG. 3, a band pass filter (BPF) is comprised of at least one filter unit 41, an input side coupling microwave strip line 42 and an output side coupling microwave strip line 43. The filter unit 41 has a V-shaped configuration provided by two arms 41*a* and 41*b* comprised of microwave strip lines facing the input and output side coupling microwave strip lines 42 and 43, respectively.

Further, the overall length of the filter unit (41) is λ/2 (λ denotes a wavelength at a frequency which is in a vicinity of an upper limit frequency but is not lower than the upper limit frequency of an operating frequency range), and the overall length of each of said arms (41*a*, 41*b*) is λ/4.

Thus, the lateral length of the BPF is shortened and the size thereof can be miniaturized.

Figure 4:
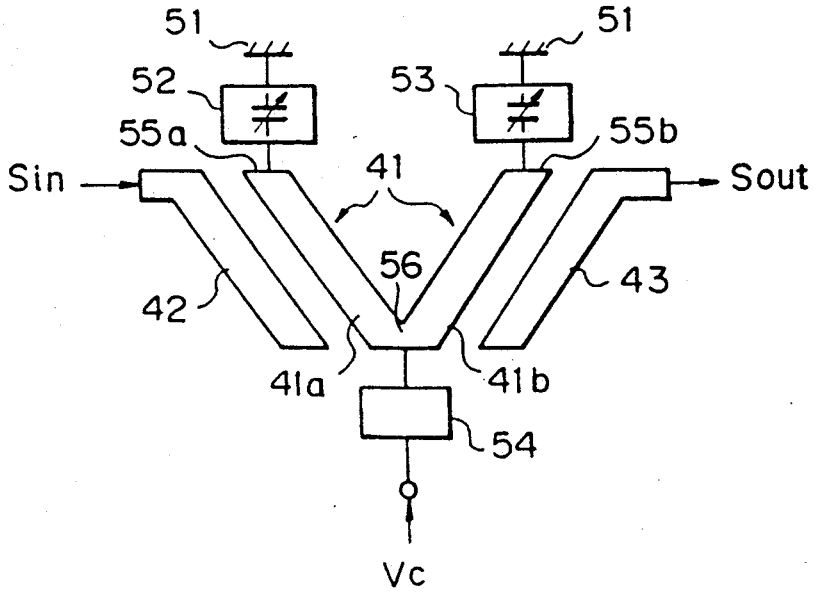
FIG. 4 depicts a principle structure of a band pass filter including a center frequency varying means.

FIG. 4 depicts a principle structure of a band pass filter including a center frequency varying means. In FIG. 4, two variable capacity elements 52 and 53 are connected to the two open ends 55*a* and 55*b* of the two arms 41*a* and 41*b* respectively, and a high frequency band elimination element 54 is connected to the apex 56 of the V-shaped filter unit 41 through which a control voltage $V_c$ is commonly applied to the variable capacity elements 52 and 53. As a result, the filter unit can function as a resonator.

As is apparent from FIG. 4, the λ/2 microwave strip line, as the filter unit 41, is bent at a short-circuit node thereof, i.e., the apex 56, so that the V-shaped configuration is formed. Further, the variable capacity elements 52 and 53 are connected between the corresponding open ends 55*a*, 55*b* and a ground 51. These variable capacity elements 52 and 53 are supplied with control voltage $V_c$ by way of the high frequency band elimination element 54 at the short-circuit node created at the center of the microwave strip line (41*a*, 41*b*), so that a resonator having a variable resonance frequency is realized.

Regarding the variable capacity elements 52 and 53, these exhibit the same susceptance with respect to the common control voltage $V_c$. This means that the short-circuit node is maintained at the position of the apex even with addition of the elements 52 and 53 to the V-shaped filter unit (41*a*, 41*b*).

Furthermore, the capacitances provided by the elements 52, 53 at the open ends 55*a*, 55*b* are maintained equal to each other with respect to any control voltage $V_c$. Therefore, the short-circuit node, along the V-shaped microwave strip line, is still maintained at the position of the apex 56 even though the voltage $V_c$ is varied. In addition, the high frequency band elimination element 54 is connected at the thus fixed short-circuit node. Therefore, the element 54 no longer has any influence on the impedance of the related resonator. This prevents a reduction of a quality factor (Q), a production of error with respect to a design value, and creation of an undesired resonance.

The variable capacity elements 52, 53 are, for example, variable capacity diodes, and the high frequency elimination element 54 is, for example, a choke element.

Figure 5:
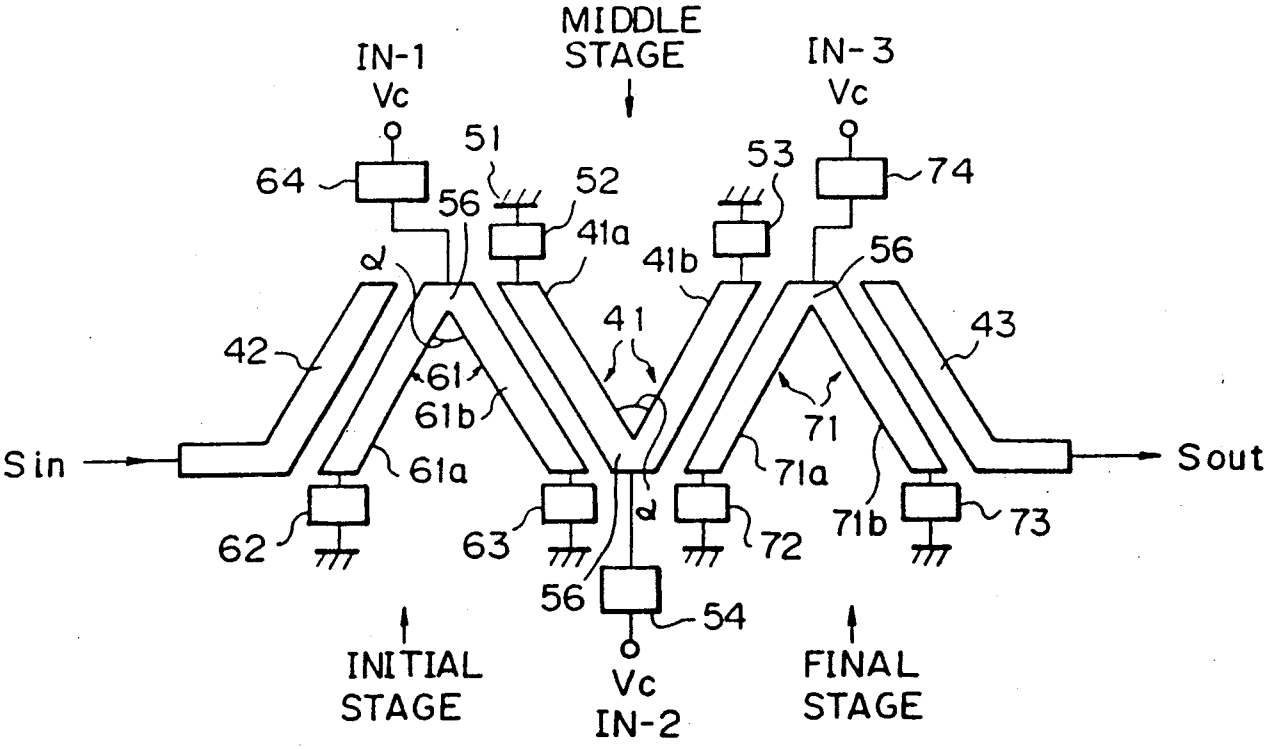
FIG. 5 illustrates a band pass filter according to an embodiment of the present invention.

FIG. 5 illustrates a band pass filter according to an embodiment of the present invention. In FIG. 5, three V-shaped filter units 61 and 71 are mounted on the dielectric substrate 20. Each of the filter units 61 and 71 is identical to the V-shaped filter unit 41 of FIG. 4 together with both variable capacity elements 62, 63, 72, and 73, and high frequency elimination elements 64 and 74 which are identical to the variable capacity elements 52, 53 (FIG. 4) and the high frequency elimination element 54 (FIG. 4).

The input side arms 41*a*, 71*a* face the output side arms 61*b* and 41*b* in parallel. The input side arm 61*a* at an initial stage filter unit 61 and the output side arm 71*b* at a final stage filter unit 71 face in parallel the input side coupling microwave strip line 42 and the output stage coupling microwave strip line 43, respectively.

Figure 6:
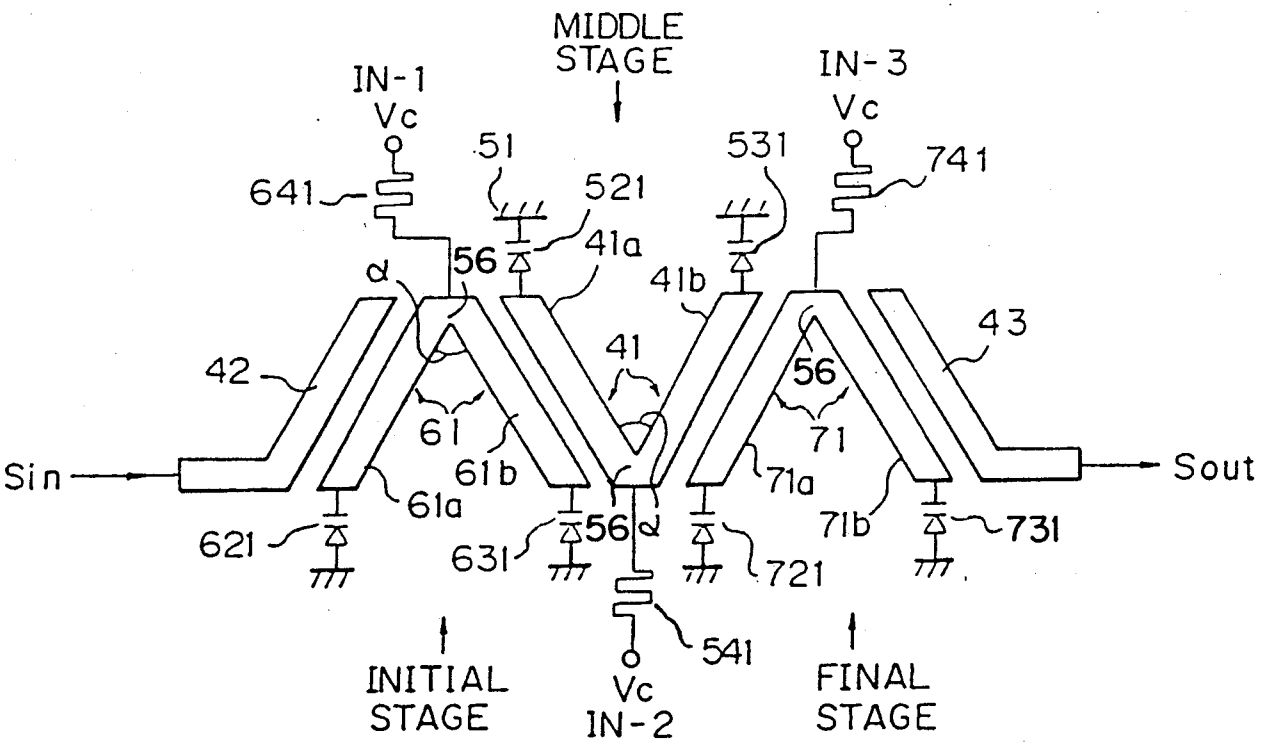
FIG. 6 illustrates a specific example of a band pass filter of FIG. 5.

FIG. 6 illustrates a specific example of a band pass filter of FIG. 5. In FIG. 6, each of the variable capacity elements 62, 63, 52, 53, 72, and 73 (shown in FIG. 5) is comprised of a variable capacity diode. Further each of the high frequency elimination elements 64, 54, and 74 (shown in FIG. 5) is comprised of a choke element.

The initial stage, middle stage, and filter units (resonators) have a predetermined resonance frequency, wherein the input side microwave strip line 42, the initial stage filter unit (resonator), the middle stage filter unit (resonator), the final stage filter unit (resonator), and the output stage microwave strip line 43 are coupled via respective electromagnetic fields therebetween at respective $\lambda/4$ wavelength portions, so that a desired filtering characteristic can be realized as a BPF.

If the control voltage $V_c$ for each variable capacity diode is varied, the variable capacity diode exhibits a corresponding capacitance value so that the resonance frequency is varied. In this case, the variable capacity diodes connected to both open ends produce the same capacitance value, so that the short-circuit node does not change its location long the V-shaped microwave strip line. This means that the choke element, connected to the short-circuit node, has no influence on the related resonator.

As mentioned previously, the $\lambda/2$ microwave strip line is bent at the short-circuit node to form a V shape, and the resonator is created having a variable resonance frequency by connecting the choke element at the short-circuit node between the variable capacity diodes and the ground 51. This enables a shortening of the lateral length of the V-shaped microwave strip line to miniaturize the size of resonator.

Consequently, there is no deterioration in filtering characteristics even if the central frequency is varied while maintaining a short lateral length of the BPF.

Regarding the inside open angle $\alpha$ in FIG. 5, it is preferably selected to be in a range $30° < \alpha < 120°$.

Figure 7:
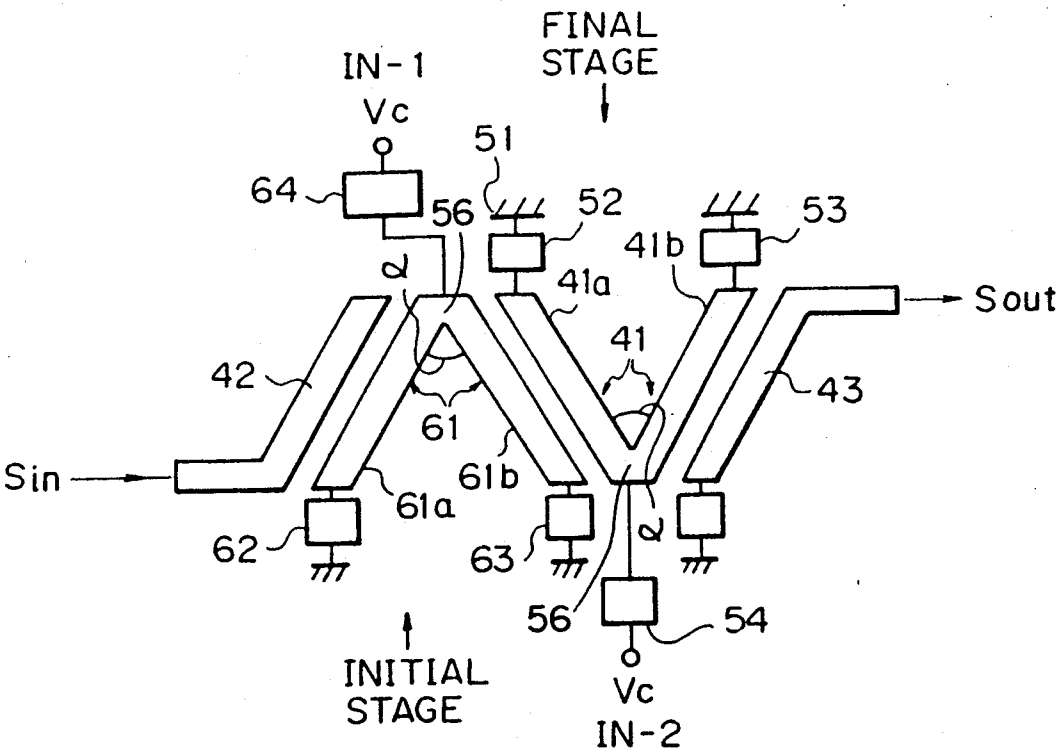
FIG. 7 illustrates a band bass filter having two filter units.

FIG. 7 illustrates a band pass filter having two filter units. The band pass filter of FIG. 7 is comprised of initial and final stage filter units 41 and 61.

As explained above in detail, the band pass filter (BPF) of the present invention is small in size compared to that of the prior art and also it produces no deterioration in the filtering characteristics even when the center frequency thereof is varied.

We claim:

1. A band pass filter comprising:

an input side coupling microwave strip line, an output side coupling microwave strip line, at least one filter unit, said filter unit having a V-shaped configuration provided by two arms of microwave strip lines having first ends connecting at an apex and second open ends, the two arms facing said input and output side coupling microwave strip lines, respectively, the overall length of said filter unit is $\lambda/2$ ($\lambda$ denotes a wavelength at a frequency which is in a vicinity of an upper limit frequency but is not lower than the upper limit frequency of an operating frequency range), and the overall length of each of the arms is $\lambda/4$, two variable capacity elements, each connected to each second open end of the two arms, and a high frequency band elimination element connected to the apex of said filter unit through which a control voltage is commonly applied to said two variable capacity elements.

2. A band pass filter as set forth in claim 1, wherein a short-circuit node is maintained at the position of said apex even with addition of said variable capacity elements to said filter unit by making the susceptance of each of the variable capacity elements equal.

3. A band pass filter as set forth in claim 2, wherein said two variable capacity elements are supplied with the same control voltage so that the variable capacity elements at the open ends have capacitances essentially equal to each other.

4. A band pass filter as set forth in claim 1, wherein said two variable capacity elements are variable capacity diodes.

5. A band pass filter as set forth in claim 1, wherein said high frequency elimination element is a choke element.

6. A band pass filter comprising:

an input side coupling microwave strip line, an output side coupling microwave strip line, at least a first and a second filter unit, each said first and second filter units having a V-shaped configuration provided by first and second arms of microwave strip lines, each having first ends connecting at an apex and second open ends, the first arm of said first filter unit facing said input side coupling microwave strip line, the first arm of said second filter unit facing said output side coupling microwave strip line and the second arms of said first and second filter units facing arms of adjoining filter units, the overall length of each said filter unit is $\lambda/2$ ($\lambda$ denotes a wavelength at a frequency which is in a vicinity of an upper limit frequency but is not lower than the upper limit frequency of an operating frequency range), and the overall length of each of the arms is $\lambda/4$.

variable capacity elements, each connected to each second open end of each arm, and high frequency band elimination elements, each connected to said apex of each filter unit through which a control voltage is commonly applied to said two variable capacity elements.

7. A band pass filter as set forth in claim 6, wherein each of said variable capacity elements is made of a variable capacity diode and each of said high frequency band elimination elements is made of a choke element.

8. A band pass filter as set forth in claim 6, wherein the arms connect at the apex with an inside opening angle $\alpha$ determined to be $30° < \alpha < 120°$.

* * * * *

UNITED STATES PATENT AND TRADEMARK OFFICE

CERTIFICATE OF CORRECTION

PATENT NO. : 5,021,757

DATED : June 4, 1991

INVENTOR(S) : Kobayashi et al.

It is certified that error appears in the above-identified patent and that said Letters Patent is hereby corrected as shown below:

Col. 2, line 24, "+" should be -- ± --;
line 52, "+" should be -- ± --;

Col. 6, line 26, after "are" insert --each--;
line 49, "4." should be --4,--;
line 53, "said" should be --an--.

Signed and Sealed this

Tenth Day of November, 1992

*Attest:*

DOUGLAS B. COMER

*Attesting Officer*

*Acting Commissioner of Patents and Trademarks*